US009015957B2

(12) United States Patent
Jung et al.

(10) Patent No.: US 9,015,957 B2
(45) Date of Patent: Apr. 28, 2015

(54) CLOTHES DRYER

(75) Inventors: Ki-Wook Jung, Gyeongsangnam-Do (KR); Myoung-Jong Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 321 days.

(21) Appl. No.: 12/935,199

(22) PCT Filed: Jun. 2, 2009

(86) PCT No.: PCT/KR2009/002930
§ 371 (c)(1),
(2), (4) Date: Sep. 28, 2010

(87) PCT Pub. No.: WO2009/148247
PCT Pub. Date: Dec. 10, 2009

(65) Prior Publication Data

US 2011/0023318 A1 Feb. 3, 2011

(30) Foreign Application Priority Data

Jun. 3, 2008 (KR) ..... 10-2008-0052323

(51) Int. Cl.
*D06F 58/00* (2006.01)
*D06F 58/06* (2006.01)

(52) U.S. Cl.
CPC ..... *D06F 58/06* (2013.01)

(58) Field of Classification Search
CPC ..... D06F 58/04; D06F 58/28; D06F 58/20; D06F 58/203; D06F 58/02; D06F 58/06; D06F 58/08; F16C 13/04
USPC ..... 34/108, 601, 75, 527, 88, 60, 130; 68/23.3, 23.7, 140; 411/389; 29/894, 29/898.07; 74/841; 384/371, 549
See application file for complete search history.

(56) References Cited

U.S. PATENT DOCUMENTS

| | | | | | |
|---|---|---|---|---|---|
| 2,089,022 | A * | 8/1937 | Delpech et al. | 373/113 |
| 4,567,633 | A * | 2/1986 | Corkery | 29/894 |
| 4,754,556 | A * | 7/1988 | Carr | 34/601 |
| 6,325,740 | B1 * | 12/2001 | Kobayashi et al. | 476/45 |
| 2007/0104556 | A1 * | 5/2007 | Downey | 411/389 |
| 2007/0154128 | A1 * | 7/2007 | Mikami | 384/627 |
| 2008/0175684 | A1 * | 7/2008 | Schmidt et al. | 409/211 |

FOREIGN PATENT DOCUMENTS

| | | | | |
|---|---|---|---|---|
| DE | 44 14 496 | C1 | | 10/1995 |
| DE | 4414496 | C1 | * | 10/1995 |
| GB | 2 124 662 | A | | 2/1984 |
| JP | 9-206500 | A | | 8/1997 |
| JP | 9-512188 | A | | 12/1997 |
| JP | 09512188 | | * | 12/1997 |
| KR | 10-2006-0077343 | A | | 7/2006 |
| KR | 10-0640846 | B1 | | 10/2006 |
| KR | 10-0680623 | B1 | | 2/2007 |
| KR | 100680623 | | * | 2/2007 |
| KR | 10-0830497 | B1 | | 5/2008 |

* cited by examiner

*Primary Examiner* — Kenneth Rinehart
*Assistant Examiner* — Bao D Nguyen
(74) *Attorney, Agent, or Firm* — Birch, Stewart, Kolasch & Birch, LLP

(57) ABSTRACT

Disclosed is a clothes dryer comprising a drum rotatably disposed in a body; and a roller disposed below the drum, and configured to support the drum. The roller is mounted to a roller shaft by a ball bearing, and a contact portion of an outer circumferential surface of the roller contacting the drum is formed to be flat.

5 Claims, 2 Drawing Sheets

CLOTHES DRYER

BACKGROUND OF THE INVENTION

1. Field of the Invention

The present invention relates to a clothes dryer, and particularly, to a structure for a roller capable of supporting a drum inside a clothes dryer.

2. Background of the Invention

Recently, a clothes dryer serves to dry an object to be dried by absorbing moisture inside the object by blowing blast generated by an electric heater or a gas heater into a drum. According to a method for processing humid air generated when drying the object, the clothes dryer is largely classified into an exhaustion-type clothes dryer and a condensation-type clothes dryer.

FIG. 1 is a view showing a clothes dryer in accordance with the conventional art.

Referring to FIG. 1, the conventional clothes dryer comprises a body 10 that forms appearance, a drum 20 rotatably installed in the body 10, a door 30 through which an object to be dried is introduced into the clothes dryer, etc. Although not shown, the conventional clothes dryer further comprises a circulation duct having both ends connected to the drum thus to form a flow path for air circulation; a heater disposed in the circulation duct for heating air; a blowing fan for forcibly circulating air; etc. The condensation-type clothes dryer comprises a heat exchanger for removing moisture included in air exhausted from the drum 20.

The drum 20 is rotated by receiving a driving force, through a belt (not shown), from a motor (not shown) installed at an inner lower side of the body 10. The clothes dryer requires a means configured to prevent the drum 20 to be downwardly deformed due to a load of laundry and a load of the drum 20, and configured to support a lower side of the drum 20 for smooth rotation of the drum 20. For this, a supporting roller 40 is generally installed below the drum 20.

FIGS. 2 and 3 are perspective and sectional views of the supporting roller.

Referring to FIGS. 2 and 3, the supporting roller 40 of the drum 20 includes a roller shaft 41; a roller frame 42 slidably installed at the roller shaft 41 and rotated; a roller outer circumferential portion 43 formed of rubber having an elastic force to support the drum 20, and attached to an outer circumference of the roller frame 42; a bearing 44 disposed between the roller frame 42 and the roller shaft 41, and configured to allow the roller frame 42 to be smoothly rotated; and a triangular pin 45 configured to support the roller frame 42 at both sides so as to prevent the roller frame 42 from being separated from the roller shaft 41.

The supporting roller 40 of the conventional clothes dryer is mounted to the roller shaft 41 by using an oil-less bearing formed between the roller frame 42 and the roller shaft 41. However, when a load supported by the bearing increases, oil included in the oil-less bearing may be discharged out. This may degrade a lubricating characteristic of the supporting roller 40, and may cause noise occurrence and damage of the supporting roller 40. Especially, in the case of 24-inch clothes dryer rather than 27-inch clothes dryer, the above problems may become more severe due to a narrow inner space and an overload.

Furthermore, in the conventional bearing, the roller outer circumferential portion 43 contacting the drum 20 has a convexed portion at a central part thereof. This may cause only parts of the entire region of the roller outer circumferential portion 43 to contact the bearing. As a result, a stress applied to the supporting roller 40 is concentrated on specific regions, thereby shortening the lifespan of the supporting roller 40.

SUMMARY OF THE INVENTION

Therefore, an object of the present invention is to provide a clothes dryer capable of providing a structure of a roller which supports a drum of the clothes dryer, the roller configured to endure even a large load applied thereto, capable of prolonging the lifespan of the roller by preventing stress concentration by increasing a contact area between the roller and the drum, and capable of enhancing the reliability.

To achieve these and other advantages and in accordance with the purpose of the present invention, as embodied and broadly described herein, there is provided a clothes dryer, comprising: a body; a drum rotatably installed in the body; and a roller disposed below the drum, and configured to support the drum, wherein the roller is mounted to a roller shaft by a ball bearing.

When coupling the roller to the roller shaft, may be used a ball bearing, not the conventional oil-less bearing. This may enable the bearing of the roller shaft to have stronger endurance against thermal deformation or abrasion due to heat.

A stopping portion for mounting the ball bearing may be formed at the roller shaft.

A screw thread for nut mounting may be further formed at one side of the roller shaft, and a screw thread for fixing the roller into the clothes dryer may be formed at another side of the roller shaft. As a nut is mounted to the screw thread after mounting the roller to the roller shaft, the roller may be more stably mounted to the roller shaft.

A contact portion of the roller contacting the drum may be formed to be flat.

The roller may comprise a roller frame configured to insert the roller shaft; and an outer wheel portion mounted to the roller frame, and configured to encompass an outer circumferential surface of the roller frame.

Since the contact portion of the roller may be formed to be flat, a stress applied to the roller may be distributed to prolong the lifespan of the roller.

A plurality of concave-convex portions may be formed on an outer circumferential surface of the roller frame, and a plurality of concave-convex portions engaged with the concave-convex portions may be formed on an inner circumferential surface of the outer wheel portion. As the concave-convex portions of the roller frame may be coupled to the concave-convex portions formed on the inner circumferential surface of the outer wheel portion, the roller frame may be stably coupled to the outer wheel portion. The outer wheel portion of the roller may be formed of rubber having an elastic force.

Under these configurations, even when a large load may be applied to the roller, the roller may endure the load. This may prolong the lifespan of the roller that supports the drum, and enhance the reliability of the clothes dryer.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Hereinafter, a clothes dryer according to the present invention will be explained in more detail with reference to the attached drawings.

Figure 1:
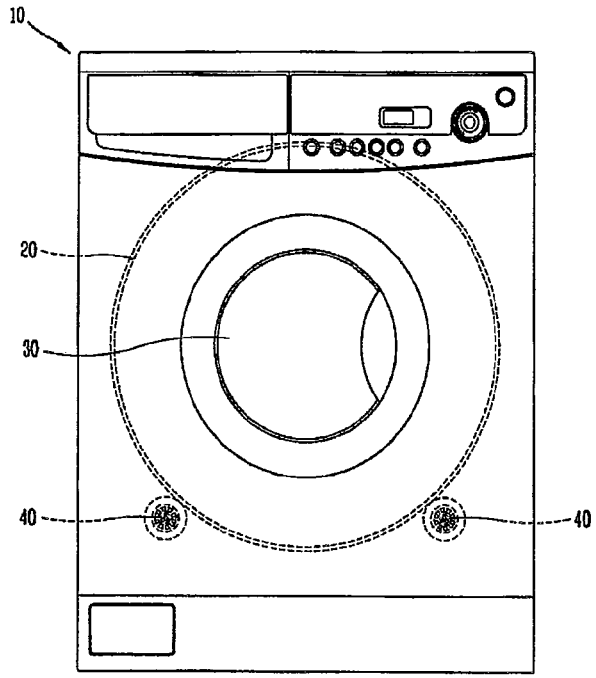
FIG. 1 is a view showing a clothes dryer in accordance with the conventional art.
Figure 2:
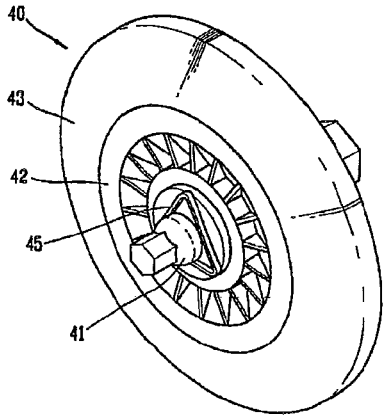
FIG. 2 is a perspective view of a roller of FIG. 1.
Figure 3:
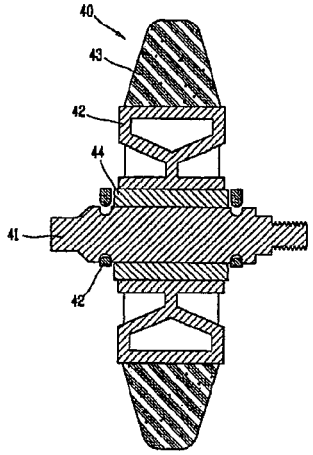
FIG. 3 is a sectional view of FIG. 2.
Figure 4:
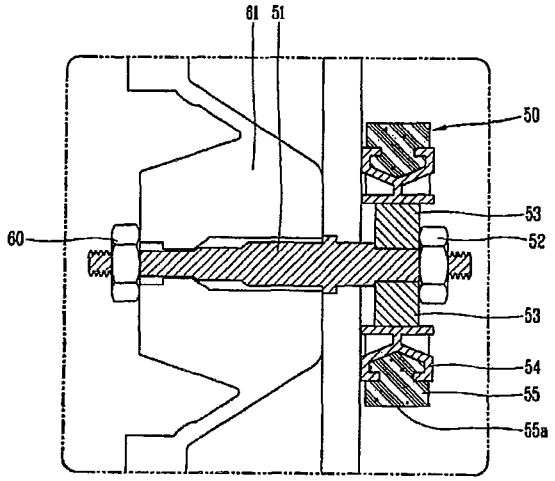
FIG. 4 is a sectional view of a roller which supports a drum of a clothes dryer according to the present invention.
Figure 5:
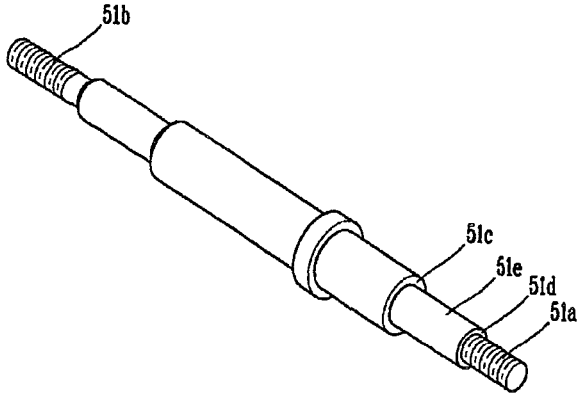
FIG. 5 is a perspective view of a roller shaft of FIG. 4.

FIGS. 4 and 5 are views respectively showing a roller for supporting a drum of a clothes dryer according to the present invention.

The roller for supporting a drum of a clothes dryer according to the present invention is mounted to a roller shaft 51 by a ball bearing 53. That is, in the present invention, the roller is provided with a ball bearing, not the conventional oil-less bearing. This may enable the bearing of the roller shaft 51 to have a stronger endurance against thermal deformation or abrasion due to heat.

The roller shaft 51 for mounting the roller is provided with a bearing mounting surface 51*e* for mounting the ball bearing 53. For stable mounting of the ball bearing 53, a stopping portion 51*c* having a diameter a little larger than that of the bearing mounting surface 51*e* is disposed on a side surface of the bearing mounting surface 51*e*. On the basis of the bearing mounting surface 51*e* of the roller shaft 51, a screw portion 51*a* for mounting a nut 52 is formed at an opposite side to the stopping portion 51*c*. A stepped portion 51*d* may be formed between the screw portion 51*a* and the bearing mounting surface 51*e*, thereby showing the position of the nut coupled to the screw portion 51*a*. After inserting the ball bearing 53 into the bearing mounting surface 51*e* of the roller shaft 51, the nut 52 is coupled to the screw portion 51*a*. As the ball bearing 53 is disposed between the stopping portion 51*c* and the nut 52, the ball bearing 53 is prevented from being separated from the roller shaft 51. That is, owing to the stopping portion 51*c* and the nut 52 mounted to the screw portion 51*a*, the ball bearing 53 can be easily and precisely mounted on the roller shaft 51, and the ball bearing 53 can be prevented from being separated from the roller shaft 51.

At one side of the roller shaft 51, the ball bearing 53 is mounted. And, another side of the roller shaft 51 is mounted to a fixing member 61 inside the clothes dryer. For this, a screw thread 51*b* is formed at another side of the roller shaft 51. The roller shaft 51 is inserted into the fixing member 61 inside the clothes dryer, and a nut 60 are coupled to the screw thread 51*b*, thereby fixing the roller shaft 51 to a predetermined position inside the clothes dryer.

An outer circumferential surface of the roller, i.e., a contact portion contacting the drum is formed to be flat. This may enable a contact surface of the roller contacting the drum to have a wider area. Therefore, a stress applied to the outer circumferential surface of the roller decreases to prolong the lifespan of the roller.

Preferably, the roller includes a roller frame 54 configured to insert the roller shaft 51 therein by using the ball bearing 53; and an outer wheel portion 55 mounted to the roller frame 54, and configured to encompass an outer circumferential surface of the roller frame 54. In this case, an outer circumferential surface 55*a* of the outer wheel portion 55 directly contacting the drum is formed to be flat thus to have a wider contact area. As the contact portion of the outer circumferential surface 55*a* contacting the drum is formed to be flat, the stress applied to the roller is distributed to prolong the lifespan of the roller.

A plurality of concave-convex portions are formed on an outer circumferential surface of the roller frame 54, and a plurality of concave-convex portions engaged with the concave-convex portions are formed on an inner circumferential surface of the outer wheel portion 55. As the concave-convex portions of the roller frame 54 are coupled to the concave-convex portions formed on the inner circumferential surface of the outer wheel portion 55, the roller frame 54 can be stably coupled to the outer wheel portion 55. The outer wheel portion 55 of the roller is preferably formed of rubber having an elastic force.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. A clothes dryer, comprising:

a body having a fixing member;

a drum rotatably installed in the body; and a roller disposed below the drum, and configured to support the drum, wherein the roller comprises:

a roller frame configured to have a roller shaft inserted therethrough;

an outer wheel portion mounted on the roller frame, and configured to encompass the outer circumferential surface of the roller frame; and a ball bearing disposed between the roller frame and the roller shaft, wherein the roller shaft comprises:

a bearing mounting surface for mounting the ball bearing;

a stopping portion disposed on a side surface of the bearing mounting surface, the stopping portion having a diameter larger than that of the bearing mounting surface;

a first screw portion for mounting a first nut formed on one end portion of the roller shaft, the first screw portion having a diameter smaller than that of the bearing mounting surface;

a stepped portion formed between the bearing mounting surface and the first screw portion, the stepped portion connecting the bearing mounting surface to the first screw portion, thereby limiting the position of the first nut coupled to the first screw portion;

a second screw portion for mounting a second nut formed on the other end portion of the roller shaft; and a protrusion portion formed to be protruded from a portion of the roller shaft, thereby limiting an inserting position of the roller shaft, wherein the ball bearing is disposed between the stopping portion and the first nut coupled to the first screw portion, and one of two side surfaces of the ball bearing comes in contact with a side surface of the stopping portion and another of the two sides surfaces of the ball bearing comes in contact with a side surface of the first nut, wherein the roller shaft is inserted into the fixing member of the body and secured to the fixing member by the second nut coupled to the second screw portion, and wherein the fixing member comprises:

an insert hole formed to have a gap between an inner surface of the fixing member and an outer surface of the roller shaft; and a support portion formed to be protruded from the inner surface of the fixing member and to contact a portion of the roller shaft inserted into the insert hole, thereby supporting the roller shaft.

2. The clothes dryer of claim 1, wherein a contact portion of the roller configured to contact the drum is formed to be flat.

3. The clothes dryer of claim 1, wherein an outer circumferential surface of the outer wheel portion of the roller is formed to be flat to contact the drum.

4. The clothes dryer of claim 1, wherein the outer wheel portion of the roller is formed of rubber having an elastic force.

5. The clothes dryer of claim 1, wherein the roller frame comprises a plurality of concave-convex portions formed on an outer circumferential surface thereof;

wherein the outer wheel portion comprises a plurality of concave-convex portions formed on an inner circumferential surface thereof; and wherein the plurality of concave-convex portions on the roller frame is engaged with the concave-convex portions on the outer wheel portion.

* * * * *